United States Patent [19]

Oliver

[11] 4,008,553

[45] Feb. 22, 1977

[54] WALL PANEL STRUCTURE AND CONNECTING MEANS THEREFOR

[76] Inventor: Wayne H. Oliver, 1305 Spring Valley Road, Minneapolis, Minn. 55422

[22] Filed: Apr. 19, 1976

[21] Appl. No.: 678,242

[52] U.S. Cl. ..... 52/584; 46/31; 52/665; 403/219; 220/4 F; 220/23.4; 220/23.6

[51] Int. Cl.[2] ..... E04B 1/08; E04C 1/10

[58] Field of Search ..... 211/194; 217/65; 46/31; 403/282, 231; 220/23.6, 23.4, 4 F; 206/821; 52/753 D, 753 Y, 753 G, 233, 582, 753 J, 754, 758 D, 271, 584, 665, 282, 666, 667, 668, 580

[56] References Cited

UNITED STATES PATENTS

| | | | |
|---|---|---|---|
| 864,801 | 9/1907 | Richards | 52/284 |
| 1,883,214 | 10/1932 | Wilson et al. | 52/282 X |
| 2,048,457 | 7/1936 | Mauser | 52/580 |
| 2,966,008 | 12/1960 | Gerholm et al. | 52/271 X |
| 3,279,140 | 10/1966 | Oliver | 52/271 X |
| 3,327,870 | 6/1967 | Fairchild, Jr. | 52/282 X |
| 3,375,631 | 4/1968 | Oliver | 52/584 |
| 3,521,420 | 7/1970 | Oliver | 52/584 |
| 3,554,382 | 1/1971 | Grinbergs | 52/586 X |
| 3,742,672 | 7/1973 | Schaeufele | 52/594 |
| 3,919,819 | 11/1975 | Oliver | 52/584 X |

FOREIGN PATENTS OR APPLICATIONS

| | | | |
|---|---|---|---|
| 250,448 | 5/1963 | Australia | 52/582 |

*Primary Examiner*—Price C. Faw, Jr.
*Assistant Examiner*—Leslie Braun

[57] ABSTRACT

Wall panels and connectors for holding the panels together at their opposite ends to provide walls and partitions for buildings, storage bins and other walled structures. Similar panels have parallel inner and outer side walls, upper and lower edge walls and opposite end elements, the upper and lower edge walls having abutting engagement with the lower and upper edge walls respectively of other panels in stacked engagement to form a wall. Connectors engage the end elements of different panels disposed at a common level to hold the panels in engagement with each other at their ends.

10 Claims, 8 Drawing Figures

WALL PANEL STRUCTURE AND CONNECTING MEANS THEREFOR

BACKGROUND OF THE INVENTION

This invention is in the nature of a modification of wall structure disclosed in my prior U.S. Pat. Nos. 3,521,420 and 3,919,819; and involves wall panels and connectors which provide a wall structure of extreme rigidity and strength and one which can be erected without the use of tools and in a minimum of time.

SUMMARY OF THE INVENTION

The wall panel structure and connecting means of this invention involves a generally rectangular panel and tubular connectors for holding said panel in engagement with other like panels at their ends. The panel has spaced parallel side walls, top and bottom edge walls, and opposite end elements, the edge walls being arranged to have interfitting engagement with edge walls of other similar panels disposed in edge wall abutting engagement with said panel. The end elements each have opposite ends disposed adjacent respective ones of said edge walls, each end element including a pair of flat sides the planes of which are angularly displaced from each other and from the planes of the side walls. The sides of each end element have aligned slots extending longitudinally inwardly toward each other from the opposite ends of said end elements. Said tubular connectors are arranged to hold said end elements in end-to-end aligned relationship with end elements of other similar panels when disposed in edge wall to edge wall abutting engagement with said panel. Each connector has pairs of aligned slots, the slots of each pair extending longitudinally inwardly toward each other from opposite ends of the connector and being spaced apart from the slots of other pairs thereof about the periphery of the connector. The slots in said end element sides and said connector are each arranged to receive portions of the connector and said end element sides respectively longitudinally inwardly of the slots thereof.

DETAILED DESCRIPTION OF THE PREFERRED EMBODIMENT

Figure 1:
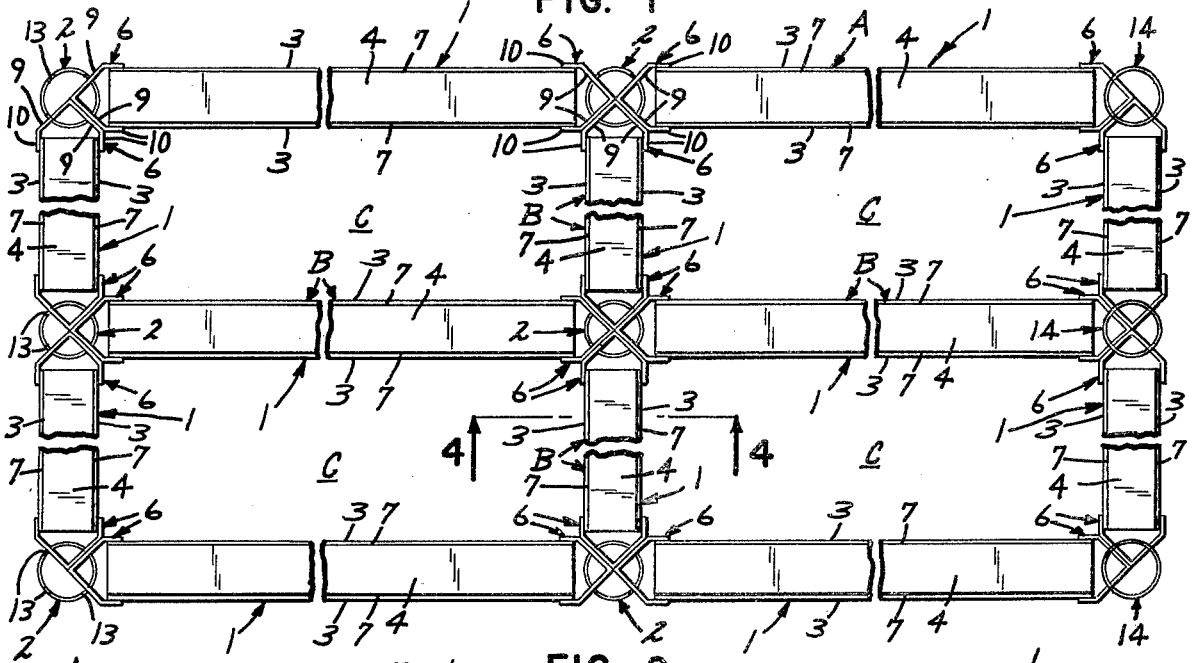
FIG. 1 is a fragmentary view in plan of a wall structure produced with the panels and connectors of this invention.
Figure 2:
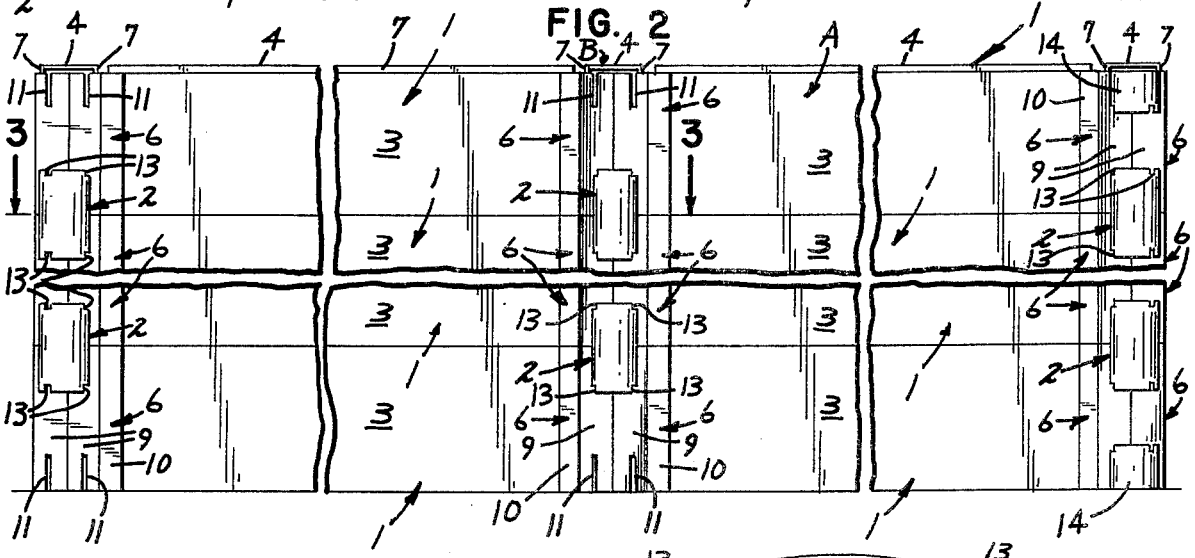
FIG. 2 is a fragmentary view in side elevation of the wall structure of FIG. 1.

In FIGS. 1 and 2, a plurality of generally rectangular panels, indicated generally at 1, are secured together by connectors 2 in a manner to produce a generally rectangular structure such as a storage bin or grain or other commodity, the bin having outer peripheral walls A and partitions B to define storage areas indicated at C.

Figure 4:
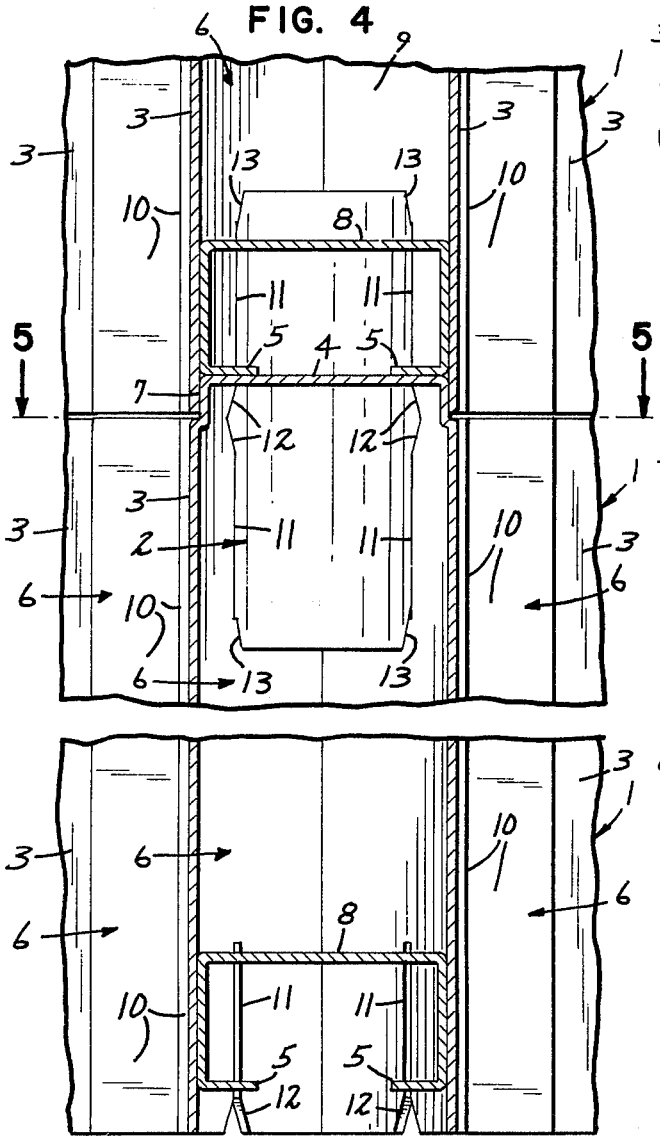
FIG. 4 is an enlarged fragmentary section taken on the line 4—4 of FIG. 1.

In the embodiment illustrated, the several panels 1 are substantially identical; hence, only one thereof need be described in detail, the parts of others thereof corresponding to said one being identified by like reference numerals. Each panel 1 is preferably fabricated from sheet metal, such as steel, and comprises laterally spaced parallel rectangular side walls 3, upper and lower edge walls 4 and 5 respectively, and end elements 6 at the opposite ends of the side walls 3. As shown, the panels 1 are vertically disposed, the upper and lower edge walls being horizontally extended, the end elements 6 extending vertically and having opposite ends disposed adjacent the upper and lower edge walls 4 and 5 respectively. The side walls 3 have upper end portions 7 that are laterally inwardly offset, the offset portions 7 being connected by the upper edge wall 4. The lower edge wall 5 is formed by a pair of laterally inwardly projecting flanges of a channel member 8 that extends horizontally between the side walls 3 from one end element 6 to the other thereof. The channel member is welded or otherwise rigidly secured to the lower portions of the side walls 3, the lower edge walls or flanges 5 being upwardly spaced from the lower extreme edges of the side walls 3 to receive the upper edge wall 4 and offset portions 7 of an underlying panel 1, the upper edge wall 4 of the underlying panel 1 abutting the lower edge wall 5 of the overlying panel 1 to support the overlying panel 1, see particularly FIG. 4.

Figure 7:
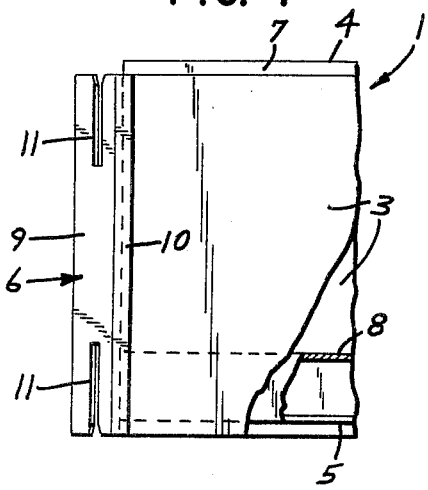
FIG. 7 is a fragmentary view in side elevation of one of the panels of this invention, some parts being broken away and some parts being shown in section.
Figure 8:
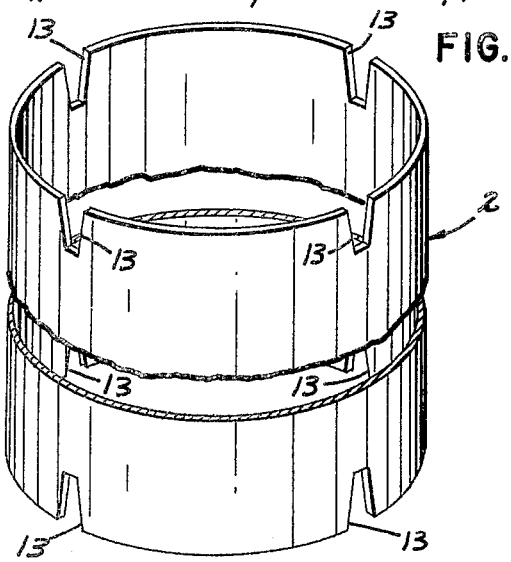
FIG. 8 is an enlarged view in perspective of one of the connectors of this invention.
Figure 3:
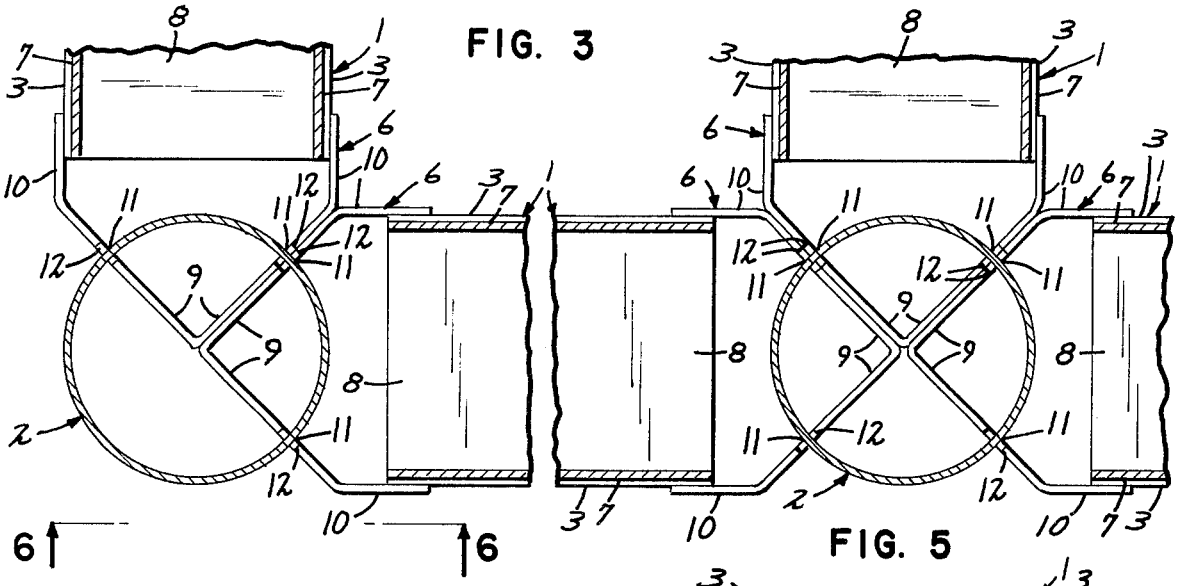
FIG. 3 is an enlarged fragmentary section taken along the line 3—3 of FIG. 2.
Figure 5:
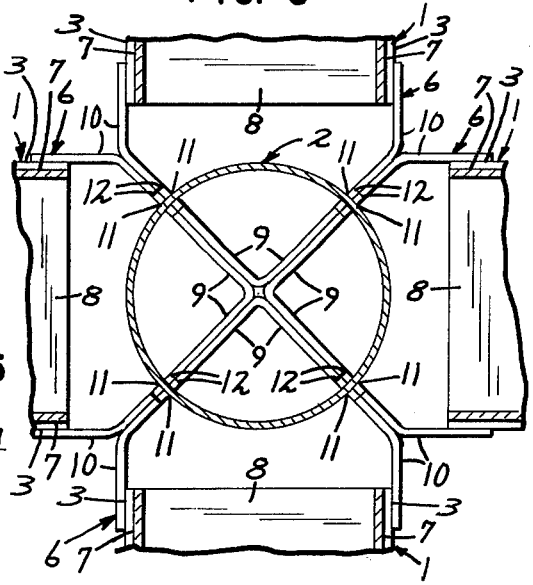
FIG. 5 is a horizontal section taken on the line 5—5 of FIG. 4.
Figure 6:
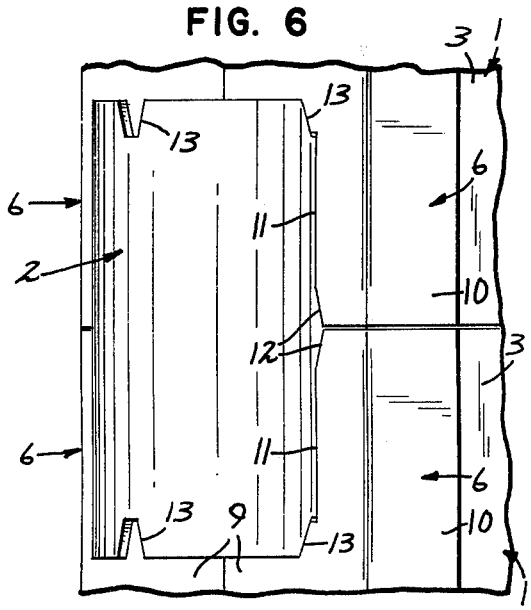
FIG. 6 is a fragmentary view in side elevation as seen from the line 6—6 of FIG. 3.

Each end element 6 is cross-sectionally of generally V-form, having generally flat sides 9 disposed at generally right angles to each other, these being bent to form mounting flange portions 10 that are welded or otherwise rigidly secured to adjacent end portions of the side walls 3, the flange portions 10 being parallel to the side walls 3. As shown, the sides 9 of each end element 6 converge in a direction longitudinally outwardly with respect to the side walls 3. Each side 9 of each end element 6 is provided with a pair of aligned slots 11 that extend longitudinally inwardly from an opposite end of their respective end element 6 toward each other. At their outer open ends, the slots 11 have longitudinally outwardly diverging portions 12, as shown particularly in FIGS. 4, 6 and 7. Further, the slots 11 in each end element 6 are so located that, when two or more panels 1 are disposed with their ends in engagement in the manner shown with end element sides 9 in face-to-face relationship, the slots 11 of the engaged faces 9 will be in register with each other, see particularly FIGS. 3 and 5.

In the embodiment illustrated, the connector 2 is shown as being a cylindrical tube. It will be appreciated that the connector tube may be of any desired cross sectional shape. Each connector 2 is formed to provide pairs of aligned slots 13, the slots of each pair extending longitudinally or axially inwardly toward each other from opposite ends of the connector 2. As shown, the pairs of slots 13 are disposed in spaced apart relationship about the periphery or circumference of each connector 2, the spacing of the slots 13 being such that they will interfit with the slots 11 of the end elements 6 of two or more panels 1, when the panels are in engagement at their ends. As shown, when panels 1 are joined by the connectors 2, the slots 11 and 13 are so interconnected that the slots 13 receive portions of the end element sides 9 longitudinally inwardly of the inner ends of the slots 11 thereof, the slots 11 receiving portions of the connectors 2 longitudinally or axially inwardly of the inner ends of the slots 13 thereof. It will be appreciated that the slots 11 and 13 are of such depth or longitudinal dimension that they permit the upper edge wall 4 of each panel 1 to abut the lower edge wall 5 of an overlying panel 1. With this arrangement, the connectors 2 operate to hold adjacent panels 1 against lateral movement relative to each other, but are not called upon to support the weight of overlying panels.

In FIG. 2, a pair of other connectors 14 are shown for joining the ends of panel 1 at the very top and bottom of a wall structure. The connectors 14 are similar to the connectors 2 but are of an axial length equal to one-half of the axial length of the connectors 2. Further, the connectors 14 have spaced slots equivalent to the slots 13 at but one end thereof. Thus, the plain ends of the connectors 14 are disposed at a common level with the ends of adjacent end elements.

Erection of a wall structure with the panels and connectors of this invention is a simple matter, requiring only the arranging of a single tier of panels 1 upon the ground or floor upon which the structure is to be erected, and connecting the panels of the first tier together with connectors 2 and 14. A second tier of panels 1 is set on the first tier and other connectors 2 applied to the upper ends of the end elements of the second tier of panels. The process is repeated until a wall structure of the desired height is attained. It will be noted that the entire wall structure is connected without the use of tools and in a minimum of time. The face-to-face engagement of the end element sides 9, as well as the nesting relationship between superposed panels at the upper and lower edges thereof provides for a wall structure that is strong and rigid, and one that can contain granular material without the danger of leakage of the material from within the interior of the structure or ingress from without by insects, rodents and the like.

While I have shown a commercial embodiment of my wall panel structure and connecting means, it will be understood that the same is capable of modification, and that modification may be made without departure from the spirit and scope of the invention, as defined in the claims.

What is claimed is:

1. Wall panel structure and connecting means comprising:

a. a generally rectangular panel having spaced parallel side walls, top and bottom edge walls and opposite end elements;

b. said edge walls being arranged to have interfitting engagement with edge walls of other similar panels disposed in edge wall abutting engagement with said panel;

c. said end elements each having opposite ends disposed adjacent respective ones of said edge walls;

d. each end element including a pair of flat sides the planes of which are angularly displaced from each other and from the planes of said side walls;

e. the sides of each end element having aligned slots extending longitudinally inwardly toward each other from said opposite ends of said end elements;

f. and tubular connectors for holding said end elements in end-to-end aligned relationship with the end elements of other similar panels when disposed in edge wall to edge wall abutting engagement with said panel;

g. each connector having pairs of aligned slots, the slots of each pair extending longitudinally inwardly toward each other from opposite ends of said connector and spaced apart from the slots of other pairs thereof about the periphery of said connector;

h. the slots in said end element sides and said connector each being arranged to receive portions of said connector and said end element sides, respectively, longitudinally inwardly of the slots thereof.

2. The wall structure and connecting means defined in claim 1 in which said end elements are hollow, said end element sides converging in directions longitudinally outwardly relative to said panel.

3. The wall structure and connecting means defined in claim 2 in which said sides of the end elements are disposed in planes normal to each other and displaced at angles of 45° from the planes of said side walls.

4. The wall panel structure and connecting means defined in claim 1 in which said lower edge walls comprise transverse flanges projecting inwardly from the side walls in upwardly spaced relation to the lower edges of said side walls, said side walls having upper edge portions disposed to be received between the lower edges of the side walls of an overlying panel for engagement of the upper edge wall of a given panel with said flanges of the overlying panel.

5. The wall panel structure and connecting means defined in claim 4 in which said upper edge portions of the side walls of each panel are offset laterally inwardly of their respective side walls, said top edge walls extending between said inwardly offset portions.

6. Wall panel structure and connecting means comprising:

a. a plurality of like panels each having spaced parallel side walls, top and bottom edge walls, and opposite end elements;

b. the side walls of each panel including portions arranged to have interfitting engagement with side wall portions of adjacent panels disposed in edge wall to edge wall abutting relationship;

c. said end elements each having opposite ends disposed adjacent respective ones of said edge walls;

d. each end element including a pair of flat sides the planes of which are angularly displaced from each other and from the planes of said side walls;

e. the sides of each end element having aligned slots extending longitudinally inwardly from the opposite ends thereof;

f. and tubular connectors for holding said panels in engagement with each other at their ends;

g. each connector having aligned pairs of slots extending longitudinally inwardly from its opposite ends for interlocking engagement between slots of the connector and the slots in said end elements.

7. The wall panel structure and connecting means defined in claim 6 in which the sides of each end element converge in direction longitudinally outwardly relative to the side walls of their respective panels.

8. The wall panel structure and connecting means defined in claim 7 in which the sides of each end element converge in directions longitudinally outwardly relative to the side walls of their respective panels.

9. The wall panel structure and connecting means defined in claim 8 in which the sides of each end element are disposed normal to each other and at an angle of 45° from the planes of their respective panel side walls.

10. The wall panel structure and connecting means defined in claim 8 in which said connectors are cross sectionally circular, said pairs of slots thereof being displaced substantially 90 circular degrees from adjacent pairs of slots.

* * * * *